US005158394A

United States Patent [19]

Bresnahan

[11] Patent Number: 5,158,394

[45] Date of Patent: Oct. 27, 1992

[54] SPREADER DEVICE FOR PARTICULATE MATERIAL

[76] Inventor: Pat Bresnahan, 3210 W. Woodhurst St., Lecanto, Fla. 32661

[21] Appl. No.: 502,838

[22] Filed: Mar. 30, 1990

[51] Int. Cl.[5] ..... E01C 19/18

[52] U.S. Cl. ..... 404/108; 404/110

[58] Field of Search ..... 404/110, 108, 105, 102, 404/83; 198/550.2

[56] References Cited

U.S. PATENT DOCUMENTS

| | | | |
|---|---|---|---|
| 1,281,141 | 10/1918 | Coultas | 404/110 |
| 1,401,149 | 12/1921 | Foster | 404/110 |
| 1,767,243 | 6/1930 | Kime | 404/110 |
| 2,197,878 | 7/1937 | Robinson | 404/110 |
| 4,322,178 | 3/1982 | Lee | 404/83 |
| 4,492,490 | 1/1985 | Christine et al. | 404/108 |
| 4,802,788 | 2/1989 | Smith | 404/94 |
| 4,878,778 | 11/1989 | Bresnahan | 404/105 |

*Primary Examiner*—Ramon S. Britts
*Assistant Examiner*—Nancy P. Connolly
*Attorney, Agent, or Firm*—Dominik, Stein, Soccocio, Reese, Colitz & Van Der Wall

[57] ABSTRACT

A device for spreading particulate material in an elongated path at a precise predetermined height. The device comprises a front panel extending vertically from an upper opening and then extending horizontally terminating at the forward edge of a lower opening. A rear panel extends vertically from the upper opening and terminates at a lower edge located at an elevation above the lower edge of the front panel. Side panels extend vertically and are coupled to the front and rear panels. The side panels have inwardly extending shoes with lower surfaces parallel with the lower edge of the horizontal portion of the front panel. An L-shaped bar is adjustably positioned adjacent to the lower edge of the rear panel for varying the height of the particulate material to be dispensed. The L-shaped bar has a vertical portion adjustably coupled with respect to the rear panel and a horizontal portion extending rearwardly from the rear panel with the lower surface thereof determining the height of the particulate material to be spread. Attachments couple the device to a truck for pulling the device simultaneously with the dispensing of particulate material into the upper opening and from the lower opening.

1 Claim, 6 Drawing Sheets

SPREADER DEVICE FOR PARTICULATE MATERIAL

BACKGROUND OF THE INVENTION

1. Summary of the Invention

This invention relates to a spreader device for particulate material and, more particularly, to a device for receiving particulate material from a dump truck pulling the device and for dispensing the received particulate material to thereby form a path of a particular height from the dispensed particulate material.

2. Description of the Background Art

A sod field is an outdoor area, generally flat, whereat new sod is generated for high quality applications such as a golf course. Two or three times a year previously prepared sod is stripped and sold for use at the new location. Proper stripping involves removal of the sod to a very precise depth. This leaves only a layer of contaminated soil. As presently practiced, particulate material is then dumped onto the contaminated soil and then graded with minimum attention paid to the precision of the depth of the new particulate material being deposited. The new material is then nurtured for the purpose of generating the new sod.

The present invention is directed to depositing particulate material onto contaminated soil for the generation of new sod to be nurtured, stripped and replaced. The invention is also capable of use in depositing particulate material on irregular surfaces which require new sod, as for example parts of golf courses which have developed irregular surfaces simply through time, use, erosion or the like. It has been found that the present invention can deposit particulate material in a path to any desired height whether on a sod field or on irregular surfaces such as a golf course since the lower surface of the particulate material will fill in holes and valleys whereby its upper surface will be at a consistent level as desired.

A large number of devices are known for the dispensing of material onto a recipient surface. By way of example, note my prior issued patent, U.S. Pat. No. 4,878,778 issued Nov. 7, 1989, directed to a concrete path paver. Such patent relates to the dispensing of concrete to form paths on a receptive surface. Such device, however, is a large, high-profile unit particularly adapted for spreading non-particulate, wet material having different characteristics from those of the present invention. Such different characteristics of material require different spending devices. Other devices for depositing concrete with the same problems as those of my prior patent include U.S. Pat. Nos. 2,332,688 to Baily; 2,664,794 to Evans; and 4,609,303 to Shumaker.

Beyond these patents, the depositing of particulate material such as asphalt is also disclosed in the prior art. Note by way of example U.S. Pat. No. 1,767,243 to Kime; 3,246,584 to Lee; 3,456,566 to Lazaro; 3,877,830 to James; 3,989,402 to James; and 4,802,788 to Smith. None of these patented prior devices, whether that of my prior patent or those of others, whether for concrete, asphalt or other materials, is directed to solving the problems encountered with particulate material as contemplated herein.

As illustrated by the great number of prior commercial devices as well as patents, efforts are continuously being made in an attempt to spread particulate material to render them more efficient, effective and economical. No prior effort, however, provides the benefits attendant with the present invention. Additionally, the prior spreaders do not suggest the present inventive combination of component elements arranged and configured as disclosed and claimed herein.

The present invention achieves its intended purposes, objects, and advantages over the prior art devices through a new, useful and unobvious combination of component elements, with the use of a minimum number of functioning parts, at a reasonable cost to manufacture, and by employing only readily available materials.

Therefore, it is an object of this invention to provide a device for spreading particulate material in an elongated path at a precise predetermined height by receiving the particulate material to be spread in an upper opening at the top of the device and by dispensing the received particulate material from a lower opening at the bottom for the device, the device comprising a front panel extending vertically from an upper opening downwardly then angling rearwardly and then extending horizontally terminating at the forward edge of a lower opening; a rear panel extending vertically parallel with the front panel and terminating at a lower edge located at an elevation above the lower edge of the front panel; side panels extending vertically and coupled at its side edges to the front and rear panels, the side panels having inwardly extending shoes with lower surfaces parallel with the lower edge of the horizontal portion of the front panel, the spacing of the side panels determining the width of the particular material to be spread; an intermediate panel extending downwardly and rearwardly from an intermediate line on the interior face of the front panel to the rearward edge of the horizontal portion and coupled at its side to the side panels; an L-shaped bar adjustably positioned adjacent to the lower edge of the rear panel for varying the height of the particulate material to be dispensed, the L-shaped bar having a vertical portion adjustably coupled with respect to the rear panel and a horizontal portion extending rearwardly away from the rear panel, the lower surface thereof determining the height of the particulate material to be spread; doors positioned in operative association with vertical openings in the side panels for the dispensing of particulate material therefrom when spread, the doors being adjustable in the extent of their opening to vary the quantity of particulate material dispensed, the doors being adjustable in their elevational extent to vary the height of particulate material to be spread; and attachment means on the exterior face of the front panel for coupling the device to a dump truck for pulling the device simultaneously with the dispensing of particulate material into the upper opening for forming an elongated path from the lower opening by the dispensed particulate material at a height determined by the adjusted height of the L-shaped bar.

It is another object of this invention to spread particulate material in a path at a predetermined precise height.

It is another object of this invention to fill the void between parallel paths of particulate material while forming one of the paths.

It is a further object of the present invention to generate new sod on a sod farm.

It is a further object of the present invention to simplify the manufacture and use of devices for depositing particulate material.

The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure.

Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into a device for spreading particulate material in an elongated path at a precise predetermined height by receiving the particulate material to be spread in an upper opening at the top of the device and by dispensing the received particulate material from a lower opening at the bottom for the device, the device comprising a front panel extending vertically from an upper opening downwardly then angling rearwardly and then extending horizontally terminating at the forward edge of a lower opening; a rear panel extending vertically parallel with the front panel and terminating at a lower edge located at an elevation above the lower edge of the front panel; side panels extending vertically and coupled at its side edges to the front and rear panels, the side panels having inwardly extending shoes with lower surfaces parallel with the lower edge of the horizontal portion of the front panel, the spacing of the side panels determining the width of the particular material to be spread; an intermediate panel extending downwardly and rearwardly from an intermediate line on the interior face of the front panel to the rearward edge of the horizontal portion and coupled at its sides to the side panels; an L-shaped bar adjustably positioned adjacent to the lower edge of the rear panel for varying the height of the particulate material to be dispensed, the L-shaped bar having a vertical portion adjustably coupled with respect to the rear panel and a horizontal portion extending rearwardly away from the rear panel, the lower surface thereof determining the height of the particulate material to be spread; doors positioned in operative association with vertical openings in the side panels for the dispensing of particulate material therefrom when spread, the doors being adjustable in the extent of their opening to vary the quantity of particulate material dispensed, the doors being adjustable in their elevational extent to vary the height of particulate material to be spread; and attachment means on the exterior face of the front panel for coupling the device to a dump truck for pulling the device simultaneously with the dispensing of particulate material into the upper opening for forming an elongated path from the lower opening by the dispensed particulate material at a height determined by the adjusted height of the L-shaped bar.

Further, the invention may be incorporated into a device for spreading particulate material in an elongated path at a precise predetermined height comprising a front panel extending vertically from an upper opening and then extending horizontally terminating at the forward edge of a lower opening; a rear panel extending vertically from the upper opening and terminating at a lower edge located at an elevation above the lower edge of the front panel; side panels extending vertically and coupled to the front and rear panels, the side panels having inwardly extending shoes with lower surfaces parallel with the lower edge of the horizontal portion of the front panel; an L-shaped bar adjustably positioned adjacent to the lower edge of the rear panel for varying the height of the particulate material to be dispensed, the L-shaped bar having a vertical portion adjustably coupled with respect to the rear panel and a horizontal portion extending rearwardly from the rear panel, the lower surface thereof determining the height of the particulate material to be spread; and attachment means for coupling the device to a truck for pulling the device simultaneously with the dispensing of particulate material into the upper opening and from the lower opening.

The L-shaped bar has vertical slots on its vertical portion coupled by bolts to apertures in the rear panel to effect the desired height adjustment. The device further includes vertical openings in the side panels and doors positioned in operative association with the openings for the dispensing of particulate material therefrom, the doors also being adjustable in the extent of their opening to vary the quantity of particulate material dispensed, the doors being adjustable in their elevational extent to vary the height to which particulate material is spread. The device further includes a plurality of bracer bars coupling the front and rear panels and spanning the upper opening with inverted V-shaped bends to assist in the coupling of the device to a truck for transportation purposes. The device further includes a funnel plate pivotally attached to the upper edge of each side plate with means to lock the plates in a vertical orientation during transportation of the device and, in the alternative, to lock the plates in an inclined orientation during operation and use for the funneling of particulate material into the device. The lower opening is defined by the rearward edge of the front plate, the interior portions of the side plates, the lower edge of the vertical portion of the L-shaped bar and the lower surface of the horizontal portion of the L-shaped bar. The device further includes a support bar secured to the interior face of the rear plate with an upper surface inclined downwardly.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purpose of the present invention. It should be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention, reference should be had to the following detailed description taken in conjunction with the accompanying drawings in which.

Similar reference characters refer to similar parts throughout the several Figures.

DETAILED DESCRIPTION OF THE INVENTION

Figure 1:
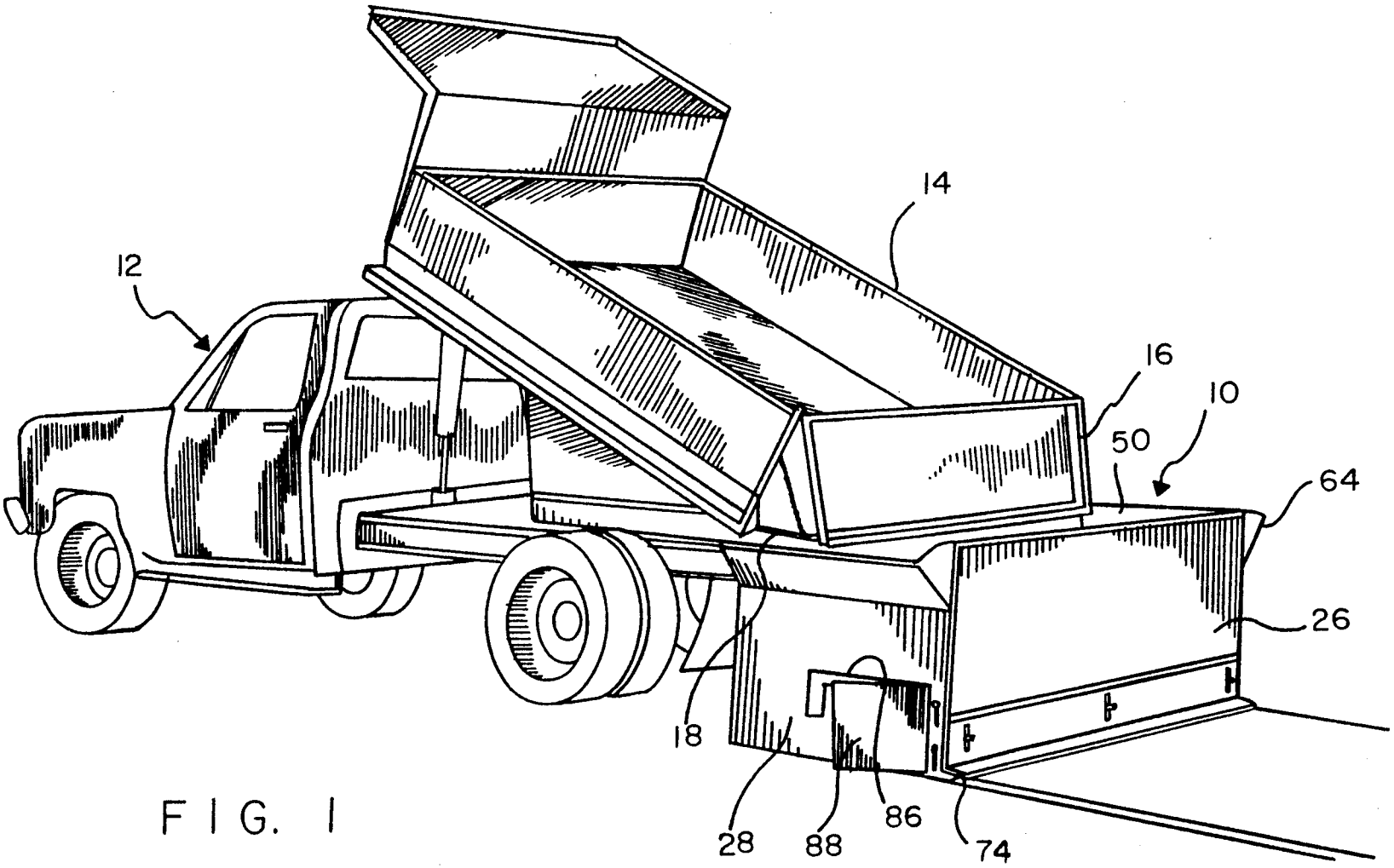
FIG. 1 is a perspective illustration of a dump truck towing the spreader device of the present invention.
Figure 2:
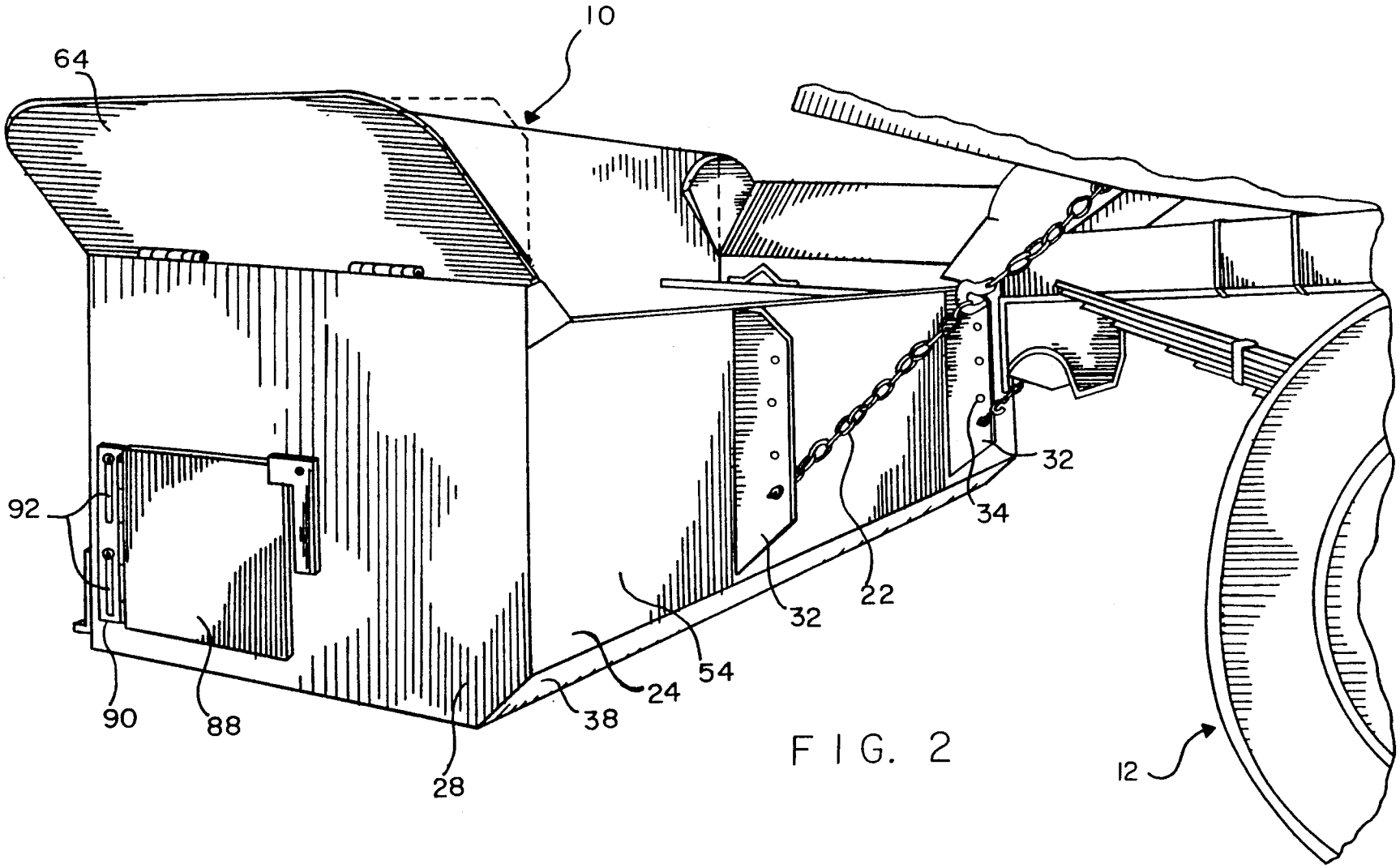
FIG. 2 is perspective illustration of the coupling between the dump truck and spreader of FIG. 1 but viewed from the opposite side.
Figure 3:
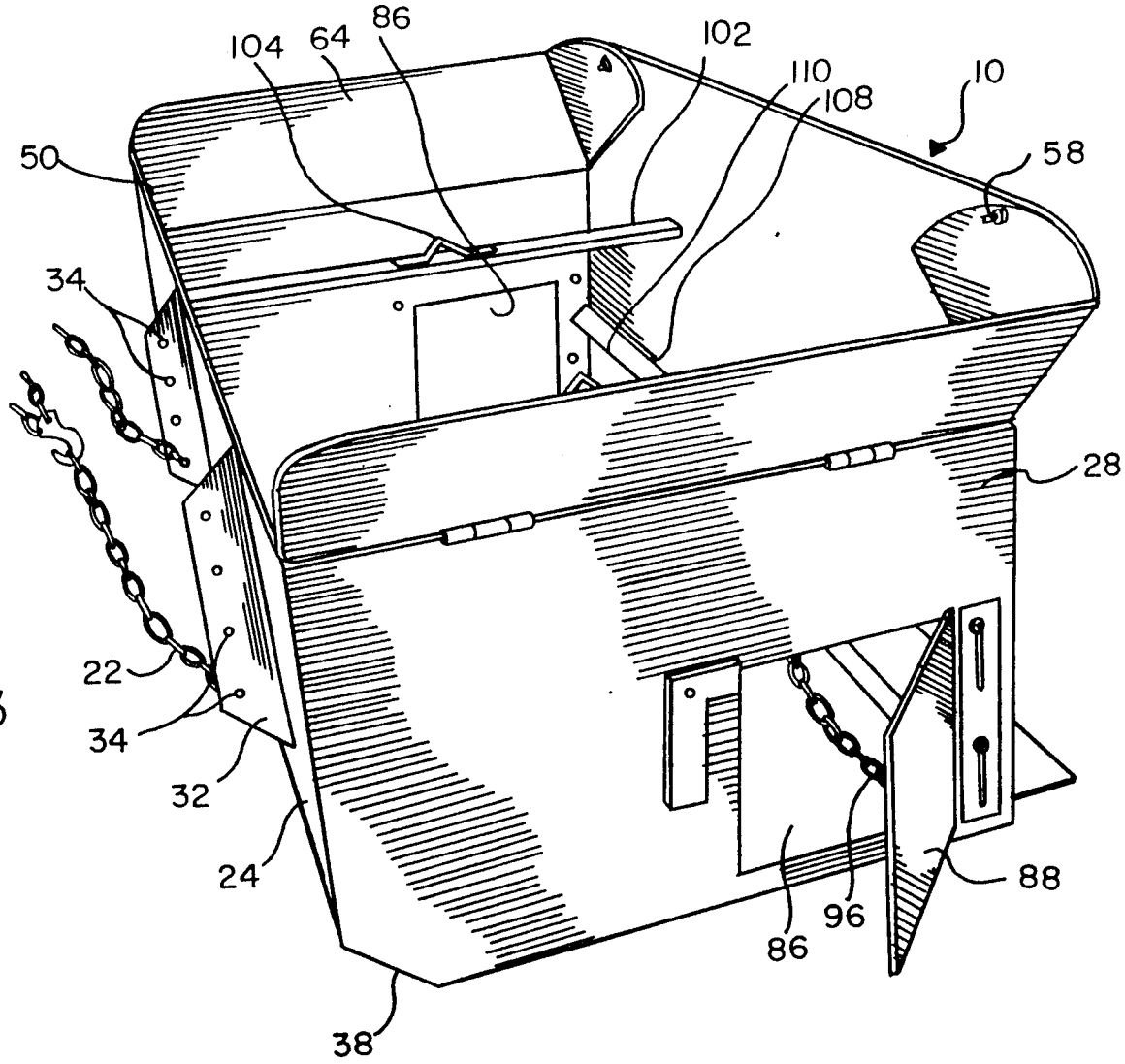
FIG. 3 is a top side perspective illustration of the device shown in FIGS. 1 and 2.
Figure 4:
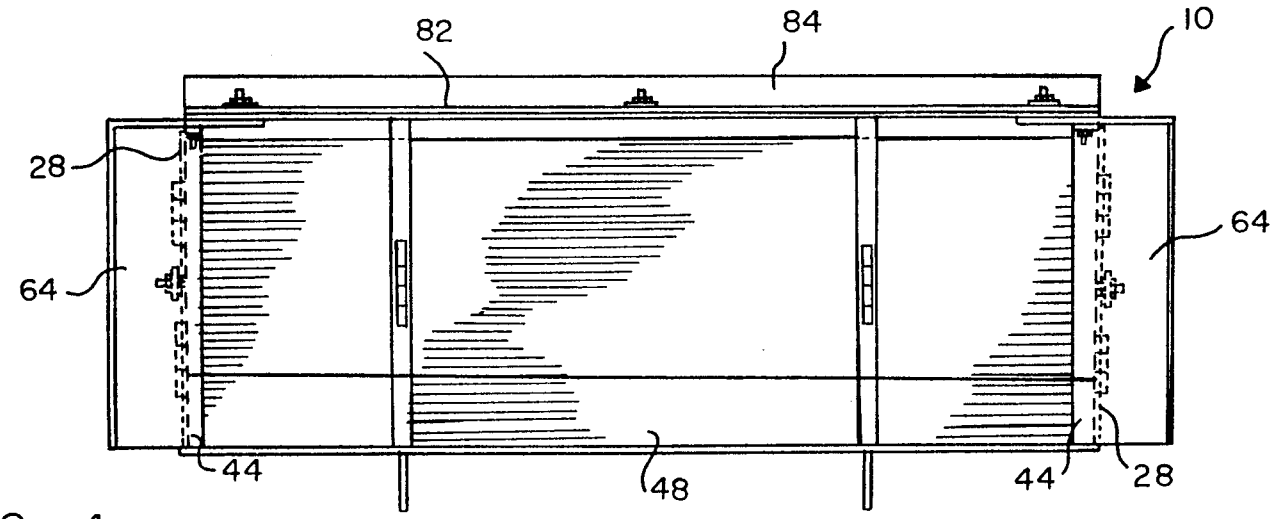
FIG. 4 is a plan view of the device shown in FIG. 1.
Figure 5:
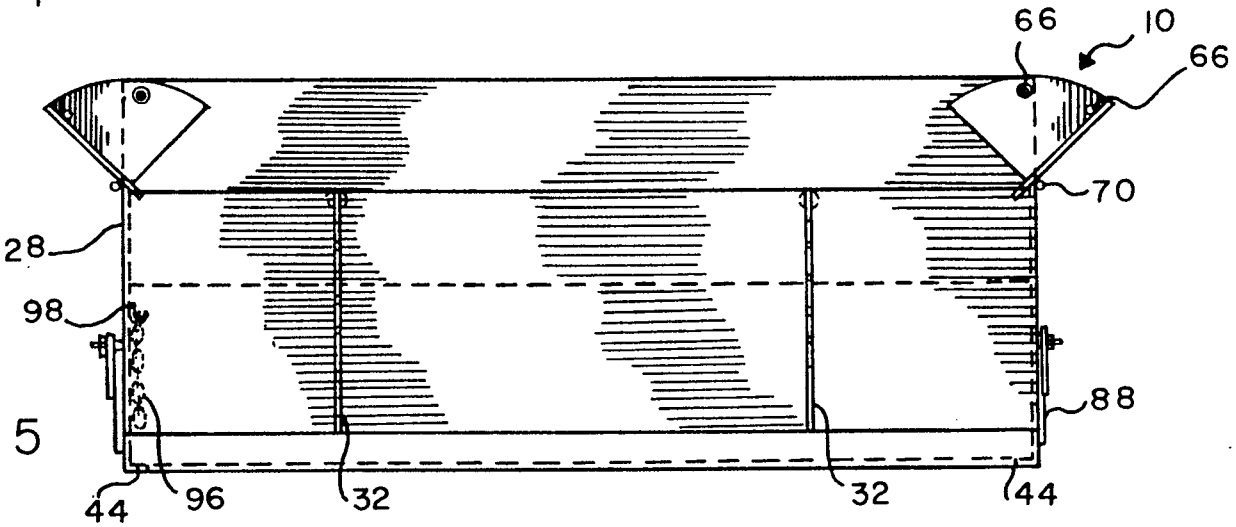
FIG. 5 is a front elevational view of the device shown in FIG. 4.
Figure 7:
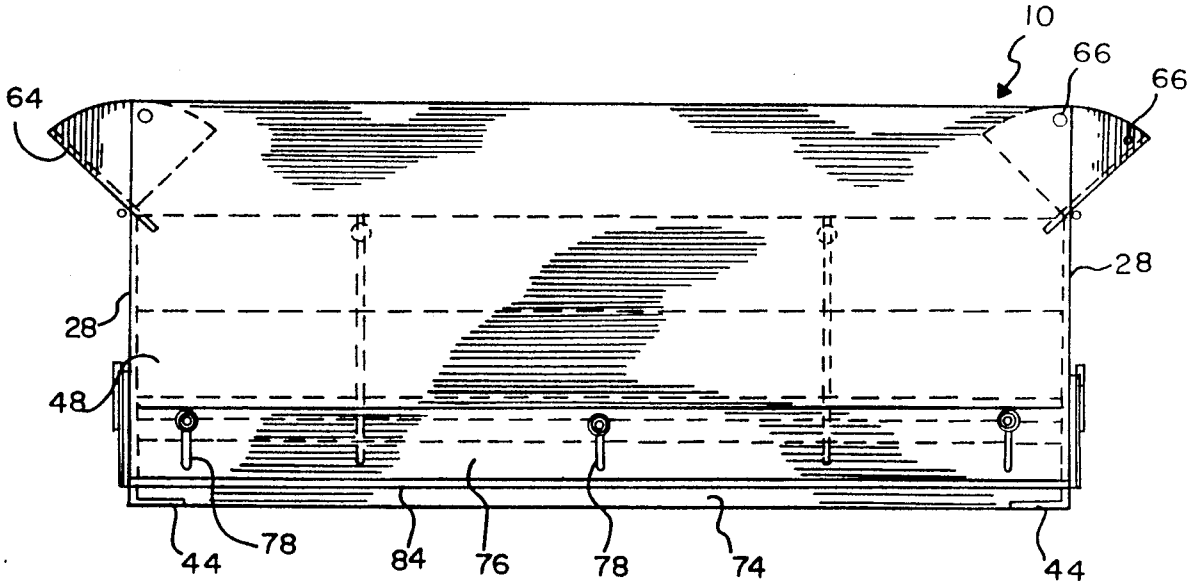
FIG. 7 is a top elevational view of the device shown in FIG. 5.
Figure 6:
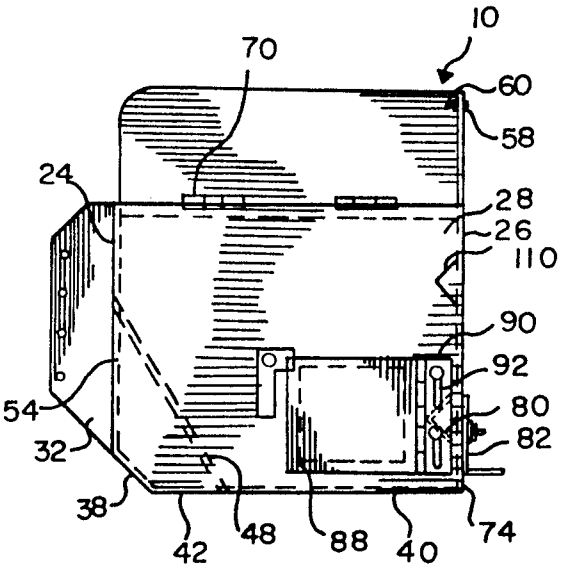
FIG. 6 is a side elevational view of the device shown in FIG. 5.
Figure 9:
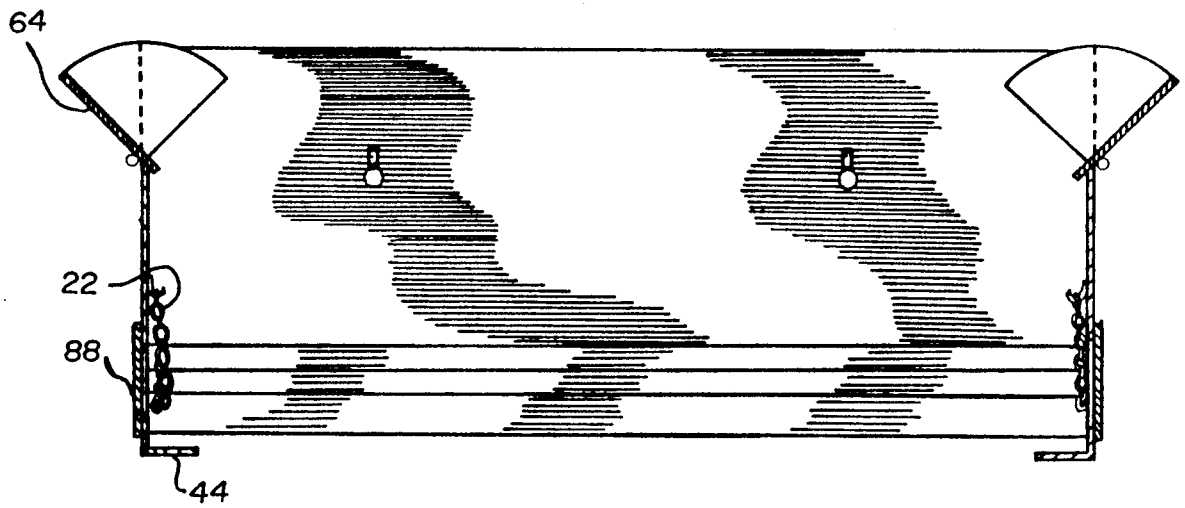
FIGS. 8 and 9 are sectional views of the device shown in FIGS. 4 through 7 taken along lines 8—8 and 9—9 of FIGS. 6 and 7 respectively.
Figure 8:
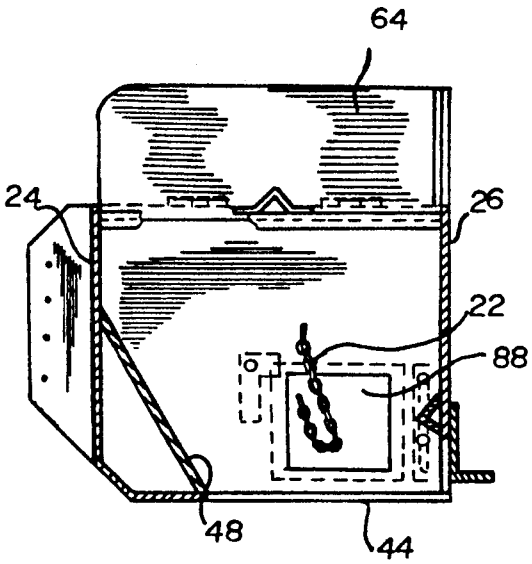

As can be seen in the various Figures, there is illustrated a spreader device 10 for sand or other particulate material. The spreader device is shown in FIGS. 1 and 2 attached to a dump truck 12 which constitutes the source of particulate material to be spread. FIG. 1 shows the truck after the tipping of the load and while performing the spreading operation. FIG. 2 is an enlarged illustration of the spreader device 10 and a portion of the truck 12.

The truck 12 is essentially conventional. It includes, on its back 14, a conventional top pivoted back panel 16. It also includes a bottom panel 18 pivoted at its lower end acting as a chute to insure that the particulate material is conveyed from the truck into the trailing spreading device 10. Coupling between the truck and the device is through a chain 22 secured between the truck and the device.

The spreader device 10 is made up of a plurality of sheets of metal formed for its particular use. The major components of the device include a front plate or panel 24, a rear plate or panel 26, and side plates or panels 28. The front panel 24 has on its forward end a pair of spaced braces 32 facing the truck 12. Each braces 32 has a plurality of apertures 34 vertically disposed one above the other for coupling to the truck through a chain 32 and appropriate attachment mechanisms on the truck and device. The particular apertures 34 utilized are a function of the height of the material to be dispensed, it weight, the speed of the truck, all coordinated to abate the possibility of tipping of the device 10 when being pulled.

The front panel 24 extends downwardly then rearwardly at an angle forming an intermediate portion 38. It then extends horizontally toward the rear panel 26. It terminates at a line transverse to the direction of motion of the truck to define the leading edge of a lower opening 40. The intermediate portion 38 of the front panel is adapted to assist in smoothing out and pressing down the particle receiving surface, normally soil, upon which the material is to be dispensed and spread. The horizontal portion 42 of the front panel 24 is to rest upon and move along the surface to receive the particulate material being spread.

The side panels 28 extend in the direction of motion of the truck 12 and the device 10. They are coupled together at their forward edges to the side edges of the front panel as by welding. At their lower edges, the side panels 28 bend inwardly to constitute horizontal shoes 44 for resting on and moving along the surface which is to receive the particulate material.

Used in cooperation with the front and side panels is an angled intermediate plate 48 in the interior of the device coupled at its upper edge to an intermediate horizontal line near the midpoint of the inner face of the front panel 24. The lower edge of the angled plate 48 is coupled to the rearward edge of the horizontal portion 42 of the front panel 24. This angled plate 48 is disposed to receive the particulate material as it drops from the truck 12 and to move it under the action of gravity through the upper opening 50 of the device 10 toward the lower opening 40 of the device 10 for being dispensed. The motion of the particulate material on the angled plate 48 adds weight to the forward section of the device 10 to assist in the holding of the front of the device downwardly for abating tipping. This also facilitates the smooth application of the particulate material and assists in smoothing out the surface receiving the particulate material.

The rear panel 26 is an essentially vertical member parallel with the vertical portion 54 of the front panel 24. Its side edges are coupled to the rearward edges of the side panels 28. The upper edge extends upwardly above the upper edges of the front and side panels 24 and 28 and is provided with both holes 58 and bolts 60 for receiving funnel plates 64 attached to the upper edges of the side panels 28. The funnel plates 64 are adapted to be located in a vertical orientation coplanar with the side panels 28 during transportation of the device so as not to be wider than the width of the truck upon which it is supported. A plurality of bolt holes 66 equally spaced from the axis of rotation of the hinges 70 between the side panels 28 and the funnel plates 64 allows for angling of the funnel plates so as to constitute funnels. Such funnels act to ensure that the particulate material dumped from the truck falls into the device 10. The funnels thus preclude the particulate material from the truck inadvertently moving to outside of the space between the plates 64 of the device 10 and restricts the material to movement through the upper opening 50 defined by the upper edges of the front, rear and side panels. The lower edge of the rear panel 26 is raised with respect to the lower edges of the side and front panels. Such a formed opening 74 allows the material deposited in the device to fall outwardly from the device, by gravity, through the lower opening when the device is pulled by the truck.

An L-shaped bar or bracket 76 is provided with slots 78 vertically aligned with apertures 80 in the rear panel 26 so as to allow for a variation in height of the horizontal, rearwardly extending portion of the L-shaped bracket. This allows for the precise deposition of particulate material onto the receptive surface. The lower opening 40 is thus formed by the rearward edge of the front panel 24, the interior portions of the side panels 28, the lower edge of the vertical portion 82 of the L-shaped bar 76 and the lower surface of the horizontal portion 84 of the L-shaped bar 76.

Also used in association with the device are openings 86 in the side panels 28. The openings 86 are preferably rectangular and are adapted to be closed by side doors 88. The side doors 88 are coupled to side panels 28 through hinges 90 coupling the doors 88 and the side panels 28. The hinges 90 are at the rearward edges of the doors. The portions of the hinges on the side panels are provided with apertures 92 so that the height of the bottom most edge of the doors 88 may be positioned at a height corresponding to the height of the horizontal portion 84 L-shaped bracket 76 to deposit the particulate material out of the side doors. The lower edges of the doors function to spread the particulate material fed from openings 86 to a height corresponding to the height of the horizontal portion 84 of the bar 76. Chains 96 coupled the interior of the doors 88 to the interiors of the side panels 26. A finger 98 inside the side panels 26 receives an appropriate length of the chain to vary the size of the openings of the doors 88 and, consequently, the amount of particulate materials to be dispensed. This dispensing is particularly useful since the inturned shoes 44 of the side plates 26 allow for movement of the device 10 in close proximity to a previously deposited strip of particulate material. The side doors can thus be used for filling in these openings between adjacent strips of deposited material.

Bracer bars 102 couple the leading edge of the front and rear panels 24 and 26 at their upper edges. An inverted V-shaped bend 104 is provided at a central extent of each bar for allowing the device 10 to be held against the back of the truck as through chains when transporting such device between sites.

An additional feature of the device is a support bar 108 extending horizontally near the midpoint of the interior face of the rear panel 26. Such bar 108 is for strenthening purposes. It has downwardly angled extent on its upper surface 110 which precludes particulate material from being caught thereon. This maximizes efficiency of the device.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described, what is claimed is:

1. A device for spreading particulate material in an elongated path at a precise predetermined height comprising:

a front panel extending vertically from an upper opening and then extending horizontally terminating at the forward edge of a lower opening;

a rear panel extending vertically from the upper opening and terminating at a lower edge located at an elevation above the lower edge of the front panel;

side panels extending vertically and coupled to the front and rear panels, the side panels having inwardly extending shoes with lower surfaces parallel with the lower edge of the horizontal portion of the front panel;

vertical openings in the side panels and having doors positioned on hinges with vertical axes at the trailing edges of the openings providing pivotal adjustment of the doors about the axes for the dispensing an amount of particulate material therefrom as a function of the position of adjustment of the doors, means provided for permitting the doors to also be adjustable in their elevational extent whereby the lower edges of the doors will vary the height to which particulate material fed through the vertical openings is spread;

an L-shaped bar adjustably positioned adjacent to the lower edge of the rear panel for varying the height of the particulate material to be dispensed, the L-shaped bar having a vertical portion adjustably coupled with respect to the rear panel and a horizontal portion extending rearwardly away from the rear panel with the lower surface thereof determining the height of the particulate material to be spread therebeneath; and attachment means for coupling the device to a truck for pulling the device simultaneously with the dispensing of particulate material into the upper opening and from the lower opening.

* * * * *